United States Patent [19]

Carreira et al.

[11] Patent Number: 4,982,237

[45] Date of Patent: Jan. 1, 1991

[54] PHOTOELECTROPHORETIC PRINTING MACHINE

[75] Inventors: Leonard M. Carreira; Frank Y. Yang, both of Penfield, N.Y.

[73] Assignee: Xerox Corporation, Stamford, Conn.

[21] Appl. No.: 313,191

[22] Filed: Feb. 21, 1989

[51] Int. Cl.[5] ..... G03G 17/04; G03G 15/10

[52] U.S. Cl. ..... 355/257; 204/300 R

[58] Field of Search ..... 355/210, 211, 212, 213, 355/257; 204/299 R, 300 R

[56] References Cited

U.S. PATENT DOCUMENTS

| | | | |
|---|---|---|---|
| 3,510,419 | 5/1970 | Carreira et al. | 204/181 |
| 3,703,459 | 11/1972 | Little, Jr. | 204/300 |
| 3,771,866 | 11/1973 | Ogawa | 355/212 X |
| 3,804,508 | 4/1974 | Mihajlov et al. | 355/257 |
| 3,859,576 | 1/1975 | Sheckler et al. | 204/300 R X |
| 3,869,612 | 3/1975 | Lenhard | 355/212 X |
| 3,945,724 | 3/1976 | Jackson | 355/257 |
| 3,988,060 | 10/1976 | Teumer | 355/257 |
| 4,063,809 | 12/1977 | Schrempp et al. | 355/213 |
| 4,073,583 | 2/1978 | Teumer et al. | 355/279 |
| 4,419,004 | 12/1983 | Kuehnle | 355/257 |
| 4,419,005 | 12/1983 | Kuehnle | 355/257 |

*Primary Examiner*—Fred L. Braun

*Attorney, Agent, or Firm*—H. Fleischer; J. E. Beck; R. Zibelli

[57] ABSTRACT

A photoelectrophoretic imaging apparatus in which a disposable, electrically biased blocking web has a portion thereof in contact with a moving heated member. A disposable imaging web, electrically biased to a polarity opposite to the polarity of the blocking web, contacts the heated portion of the blocking web. Photosensitive particles dispersed in a normally solid waxy binder matrix are interposed between the imaging web and the blocking web. A light image is projected onto the heated portion of the imaging web contacting the blocking web causing selective migration of the photosensitive particles in the liquefied waxy binder matrix in image configuration.

17 Claims, 2 Drawing Sheets

PHOTOELECTROPHORETIC PRINTING MACHINE

This invention relates generally to a, photoelectrophoretic printing machine, and more particularly concerns a disposable, heated blocking electrode and a disposable imaging layer adapted to form particle images on their respective surfaces.

In the process of photoelectrophoretic imaging, monochromatic, i.e. black and white images, or polychromatic, i.e. full color images, are formed through the use of photoelectrophoresis. Typically, photosensitive particles are suspended in a non-conductive liquid carrier. The suspension is placed between electrodes. One of the electrodes is at least partially transparent, and subjected to a potential difference. The suspension is then exposed to an image through the partially transparent electrode. Inasmuch as the particles are electrically photosensitive, they undergo a net change in charge polarity when exposed to activating electromagnetic radiation through interaction with one of the electrodes. This results in selective particle migration in image configuration, forming a visible, particle image at one of the electrodes and the negative, or compliment thereof, at the other electrode. In a monochromatic system, particles of a single color may be used, producing a single color image equivalent to a conventional black-and-white photograph. In a polychromatic system, the images are produced in natural color because mixtures of particles of two or more different color particles, which are sensitive only to light of a specific wavelength or narrow range of wavelengths are used. After exposure and particle migration, the electrodes are separated and the carrier liquid is evaporated. The particle image is then transferred from the electrode to a copy sheet.

The handling of a liquid suspension is inherently inconvenient and does not readily lend itself to the development of a commercial printing machine. One approach that has been developed is to suspend the particles in a waxy substance. The waxy substance is then heated during exposure enabling selective particle migration. However, it has been difficult to transport the particles in the waxy substance during the imaging process while still providing heat. Hereinbefore, various techniques have been devised for implementing the photoelectrophoresis imaging process. The following disclosures appear to be pertinent:

U.S. Pat. No. 3,510,419
Patentee: Carreira et al.
Issued: May 5, 1970
U.S. Pat. No. 3,703,459
Patentee: Little, Jr. et al.
Issued: Nov. 21, 1972
U.S. Pat. No. 3,804,508
Patentee: Mihajlov et al.
Issued: Apr. 16, 1974
U.S. Pat. No. 4,073,583
Patentee: Teumer et al.
Issued: Feb. 14, 1978
U.S. Pat. No. 4,419,004
Patentee: Kuehnle
Issued: Dec. 6, 1983
U.S. Pat. No. 4,419,005
Patentee: Kuehnle
Issued: Dec. 6, 1983

The relevant portions of the foregoing disclosures may be briefly summarized as follows:

U.S. Pat. No. 3,510,419 discloses a photoelectrophoretic imaging process wherein an imaging layer having photosensitive particles dispersed in a waxy binder are coated on the surface of an insulating flexible sheet. The coated sheet is placed with its coated side against a conductive electrode. An AC power source is connected to the conductive electrode and activated to heat the electrode and melt the waxy binder.

U.S. Pat. No. 3,703,459 describes a photoelectrophoretic imaging apparatus for applying a liquid film of imaging suspension to an injecting electrode. A receiving sheet, in the form of a paper web, is fed from a supply roll and passes between an injecting electrode and a blocking electrode and is rewound on a take-up roller. A heated metallic shoe, in contact with the underside of the paper web, supplies the energy for fixing the image thereon.

U.S. Pat. No. 3,804,508 discloses an apparatus for fixing a particulate electrophoretic image. A continuous web of transfer material is coated with a thermo-adhesive layer. The web is mounted on a supply roller and passes in contact with a heated guide roller. The heated guide roller heats the thermo-adhesive layer on the web above its softening temperature. In this way, a particulate image may be embedded in the softened surface of the thermo-adhesive layer.

U.S. Pat. No. 4,073,583 describes a device for photoelectrophoretically transferring and fixing an image in one step by the application of heat and pressure. A coated paper web passes between two rollers. One of the rollers is heated. In this way heat and pressure are applied to substantially transfer all the pigmented particles to the coated paper web.

U.S. Pat. No. 4,419,004 and U.S. Pat. No. 4,419,005 disclose an apparatus wherein toner particles are electrophoretically transferred to a resin coated surface of a transfer sheet. The transfer sheet is locally heated to soften the resin coating whereby toner particles may be embedded within the coating.

In accordance with one aspect of the present invention, there is provided a photoelectrophoretic imaging apparatus including a moving, heated member. A disposable, electrically biased blocking web is adapted to have a portion thereof contact the heated member and move in synchronism therewith. A disposable imaging web, electrically biased to a polarity opposite to the polarity of the blocking web, is adapted to contact the heated portion of the blocking web. Photosensitive particles dispersed in a normally solid waxy binder matrix are interposed between the blocking web and imaging web so that the heated member liquefies the waxy binder matrix. Means are provided for projecting a light image onto the heated portion of the imaging web contacting the blocking web causing selective migration of the photosensitive particles in the liquefied waxy binder matrix in image configuration.

Other aspects of the present invention will become apparent as the following description proceeds and upon reference to the drawings, in which.

While the present invention will hereinafter be described in conjunction with various embodiments thereof, it will be understood that it is not intended to limit the invention to these embodiments. On the contrary, it is intended to cover all alternatives, modifications, and equivalents as may be included within the spirit and scope of the invention as defined by the appended claims.

Figure 1:
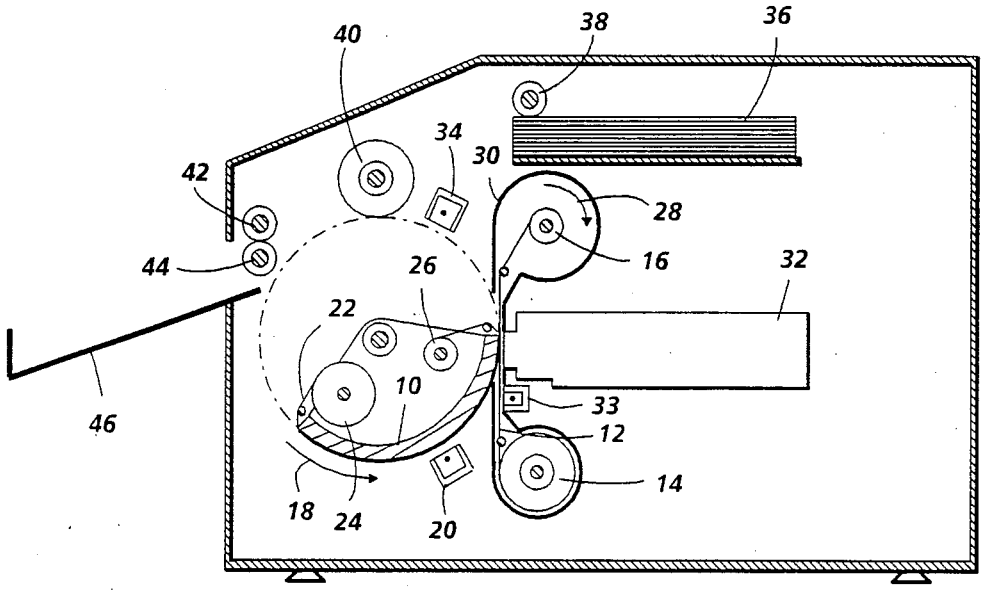
FIG. 1 is a schematic elevational view showing one embodiment of a photoelectrophoretic printing machine incorporating the features of the present invention therein.

Turning now to FIG. 1, FIG. 1 depicts one embodiment of a photoelectrophoretic printing machine incorporating the features of the present invention therein. As shown in FIG. 1, arcuate member 10 is heated by a power supply coupled to heaters disposed therein. Arcuate member 10 may be made from a suitable metal material such as aluminum, brass, stainless steel, nickel, zinc, amongst others. A blocking web 22 is advanced from a supply roll 24 around the exterior surface of arcuate member 10 onto a take-up roll 26. Blocking web 22 includes photosensitive particles dispersed in a wax-like insulating binder coated on the surface of an insulating flexible sheet. The wax or wax-like binder matrix may be any suitable material. Preferably, a parafin wax, such as Bioloid, is used because of its chemical purity and commercial availability. Arcuate member 10 is rotated by a motor in the direction of arrow 18. Supply roll 24 and take-up roll 26 are mounted on the interior frame of arcuate member 10 and rotate therewith. Prior to exposure, an un-used segment of the blocking web is advanced from supply roll 14 over the exterior surface of arcuate member 10. The used segment of the blocking web is advanced onto take-up roll 26. A motor, coupled to take-up roll 26, rotates take-up roll 26 to advance an un-used segment of blocking web 22 from supply roll 24 about the exterior surface of arcuate member 10. The used segment of blocking web 22 is advanced onto take-up roll 26. In this way, the used blocking web is wound about the take-up roll and may be later disposed of. Preferably, the blocking web is made from an insulative material.

Initially, the un-used segment of the blocking web wrapped about arcuate member 10 moves in synchronism therewith to pass through a charging station where corona generating device 20 forms a substantially uniform charge across the blocking web. Thereafter, the charged blocking web passes through the exposure station. Before exposure, arcuate member 10 is heated to melt the wax-like insulating binder on the blocking web. The heated blocking web then passes through the exposure station. At the exposure station, an imaging web 12 contacts blocking web 22. Imaging web 12 is substantially transparent. A supply roll 14 stores un-used portions of the imaging web. A take-up roll 16 receives the used portions of the imaging web. A motor rotates take-up roll 16 in the direction of arrow 28 to advance the imaging web through the exposure station onto take-up roll 16. In this way, the used portions of the imaging web are wound about the take-up roll for subsequent disposal. Imaging web 12 is made from any suitable flexible transparent conductive material. Preferably, conductive web 12 is made from a polyethylene terephthalate polyester film, i.e. Mylar, overcoated with a thin transparent conductive material, e.g. a white light transmissive layer of aluminum. Supply roll 14 and take-up roll 16 are mounted in a cartridge 30 having an aperture in the region wherein imaging web 12 contacts blocking web 22. A cathode ray tube projects a positive light image onto imaging web 12 in the region of contact. Before imaging web 12 contacts blocking web 22, corona generating device 33 forms a substantially uniform charge across the imaging web. The charge on the imaging web is of an opposite polarity to the charge on the blocking web. During imaging, the imaging web and the blocking web are in contact with one another. Exposure of the imaging web is accomplished at the same time as heat is being applied thereto. This liquefies the wax on the blocking web permitting migration of the photosensitive particles. The imaging web is electrically biased to a polarity opposite to that of the blocking web so as to provide an electrical field for imaging. The light image projected through the imaging web onto the heated, blocking web selectively discharges the photosensitive particles causing particle migration. In this way, a positive particle image is formed on the blocking web and a negative or complimentary particle image on the imaging web. The imaging web advances in synchronism with the rotation of arcuate member 10. Arcuate member 10 with blocking web 22 thereon continues to rotate in the direction of arrow 18. In this way, successive un-used portions of the blocking web and the imaging web are disposed at the aperture so as to be exposed by the light image from the cathode ray tube. Corona generating device 34 recharges the blocking web as the particle image is advanced through the transfer station. At the transfer station, a copy sheet is advanced from a stack of copy sheets 36 by a rotating feed roll 38. The copy sheet is advanced into a nip defined by an electrically biased transfer roll 40 and blocking web 22 on arcuate member 10. In this way, the positive particle image adhering to blocking web 22 is transferred to the copy sheet. The copy sheet with the particle image adhering thereto advances into a nip defined by a pair or rollers 42 and 44. These rollers apply heat and pressure to the particle image to permanently fix the particle image to the copy sheet. The copy sheet with the particle image fixed thereto in then advanced to a catch tray 46 for removal from the printing machine by the operator. After the particle image is transferred to the copy sheet, an unused segment of blocking web is advanced from supply roll 24 about the exterior surface of arcuate member 10 in preparation for the next imaging cycle.

Figure 2:
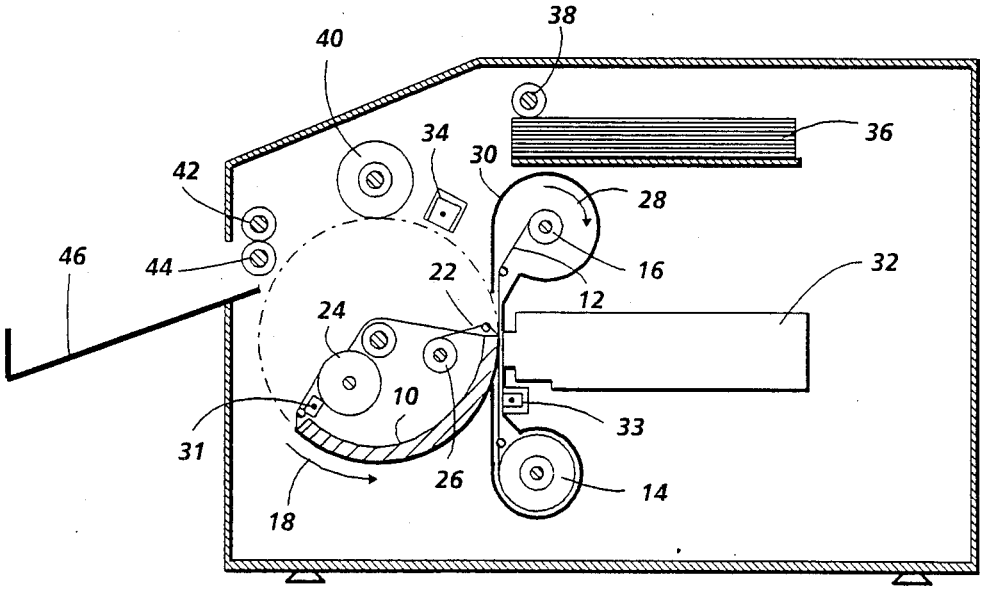
FIG. 2 is a schematic elevational view showing another embodiment of a photoelectrophoretic printing machine incorporating the features of the present invention therein.

Referring now to FIG. 2, there is shown another embodiment of the photoelectrophoretic printing machine. As depicted thereat, arcuate member 10 has blocking web 22 wrapped about the exterior surface thereof. Supply roll 24 and take-up roll 26 are mounted on the interior frame of arcuate member 10 and rotate therewith in the direction of arrow 18. Imaging web 12 is mounted in cartridge 30. Take-up roll 26 is rotated to advance imaging web 12 from supply roll 14 past the aperture in cartridge 30 in synchronism with the rotation of arcuate member 10. Imaging layer 12 includes photosensitive particles dispersed in a wax-like insulating binder. As the imaging web is advanced from the supply roll, it is substantially uniformly charged by corona generating device 33. The charge on the imaging web is of an opposite polarity to the charge on the blocking web. The arcuate member is heated and, as it contacts the imaging web, liquefies the wax-like binder permitting particle migration during imaging. During imaging, cathode ray tube 32 projects a negative light image through the imaging web to selectively discharge the photosensitive particles causing particle migration. This forms a positive particle image on the blocking web and a negative particle image on the imaging web. As the arcuate member continues to rotate in the direction of arrow 18, the blocking web advances therewith and is charged by corona generating device 34. A copy sheet is advanced by feed roll 38 from stack 36 into the nip defined by transfer roll 40 and blocking web 22. The transfer roll is electrically biased so that the particle image transfers from the blocking web to the copy sheet. Thereafter, the copy sheet with the particle image thereon advances into the nip defined by rollers 42 and 44. Rollers 42 and 44 apply heat and pressure to the particle image so as to permanently fix the particle image to the copy sheet. The copy sheet with the particle image fused thereon is then advanced to catch tray 46 for subsequent removal from the printing machine by the operator. After the particle image has been transferred from the blocking web to the copy sheet, an unused segment of the blocking web is advanced from the supply roll about the exterior surface of the arcuate member. The used segment is advanced onto the take-up roll.

Figure 3:
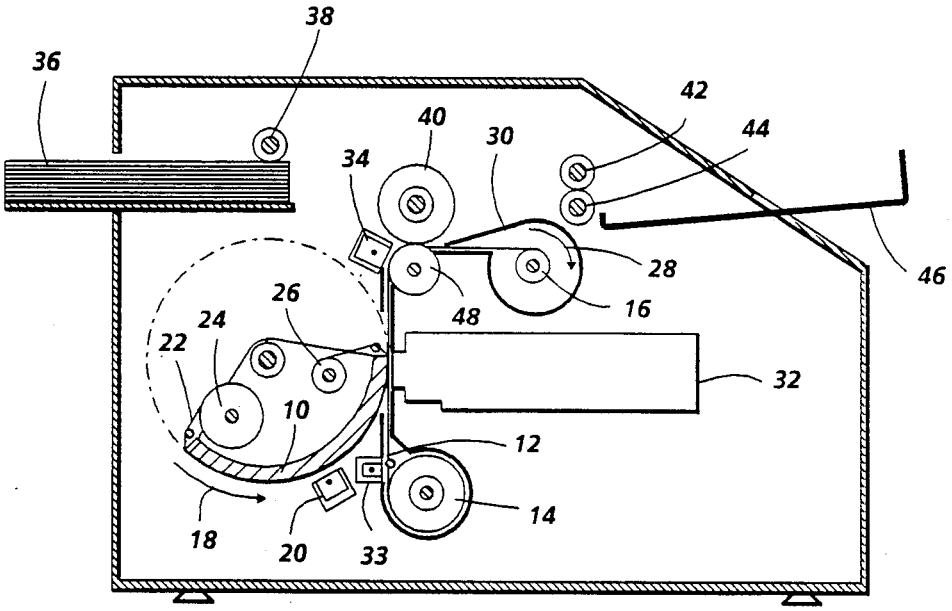
FIG. 3 is a schematic elevational view showing still another embodiment of a photoelectrophoretic printing machine incorporating the features of the present invention therein.

Turning now to the embodiment depicted in FIG. 3, this embodiment is similar to the embodiment shown in FIG. 2. Once again, blocking web 22 is wrapped about the exterior surface of arcuate member 10. As arcuate member 10 rotates in the direction of arrow 18, blocking web 22 moves therewith and is uniformly charged by corona generating device 20. Corona generating device 33 charges imaging web 12 as it advances from supply roll 14 onto take-up roll 16. At the aperture in cartridge 30, imaging web 12 contacts blocking web 22. Heat from arcuate member 10 liquefies the waxy binder of the imaging layer. Cathode ray tube 32 projects a positive light image through the transparent layer of the imaging web to selectively discharge the photosensitive particles causing particles migration. This forms a positive particle image on the imaging web and a negative particle image on the blocking web. After exposure, corona generating device 34 charges imaging web 12. A copy sheet is advanced from stack 36 by feed roll 38 into the nip defined by transfer roll 40 and imaging web 12. Roller 48 presses imaging web 12 against transfer roll 40. Transfer roll 40 is electrically biased so that the positive particle image on the imaging web is transferred to the copy sheet. Thereafter, the copy sheet advances into the nip defined by rollers 42 and 44. These rollers apply heat and pressure to the particle image to permanently fix the particle image to the copy sheet. The copy sheet with the particle image fixed thereto, is then advanced to catch tray 46 for subsequent removal from the printing machine by the operator. After, imaging, the used segment of the blocking web is advance onto the take-up roll and an unused segment advanced from the supply roll about the exterior surface of the arcuate member for the next imaging cycle.

In recapitulation, it is clear that in the present invention various embodiment of a photoelectrophoretic printing machine use a heated arcuate member for activating photosensitive particles in a waxy binder adhering to either the blocking web or the imaging web. The blocking web is wrapped about the exterior surface of the heated arcuate member and negative or positive images may be projected by a cathode ray tube onto the imaging web. In this way, the waxy binder is liquefied enabling particle migration to form one particle image on the imaging web and the negative or compliment thereof on the blocking web. The particle image is transferred from either the blocking web or the imaging web to a copy sheet and permanently fixed thereto. Successive used portions of both the blocking web and imaging web are wound about a take-up roll for subsequent disposal.

It is, therefore, evident that there has been provided in accordance with the present invention, an apparatus that fully satisfies the aims and advantages heretofore mentioned. While this invention has been described in conjunction with various embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A photoelectrophoretic imaging apparatus, including:

a moving, heated member;

a disposable, electrically biased blocking web adapted to have a portion thereof contact said heated member and move in synchronism therewith;

a disposable imaging web electrically biased to a polarity opposite to the polarity of said blocking web and being adapted to contact the heated portion of said blocking web with photosensitive particles dispersed in a normally solid waxy binder matrix being interposed between said imaging web and said blocking web so that said heated member liquefies the waxy binder matrix; and means for projecting a light image onto the heated portion of said imaging web contacting said blocking web causing selective migration of the photosensitive particles in the liquefied waxy binder matrix in image configuration.

2. An apparatus according to claim 1, wherein a positive particle image is formed on said imaging web and a negative particle image on said blocking web.

3. An apparatus according to claim 2, further including means for transferring the positive particle image from said imaging web to a sheet.

4. An apparatus according to claim 3, wherein said heated member is an arcuate member.

5. An apparatus according to claim 4, wherein said projecting means includes a cathode ray tube.

6. An apparatus according to claim 5, wherein said cathode ray tube projects a positive image onto said imaging web.

7. An apparatus according to claim 6, wherein said blocking web is entrained about said arcuate member.

8. An apparatus according to claim 3, further including:

means for storing unused portions of said imaging web;

means for receiving used portions of said imaging web; and means for advancing the used portion of said imaging web to said receiving means.

9. An apparatus according to claim 8, further including:

means for storing unused portions of said blocking web;

means for receiving used portions of said blocking web; and means for advancing the used portion of said blocking web to said receiving means.

10. An apparatus according to claim 1, wherein a positive particle image is formed on said blocking web and a negative particle image on said imaging web.

11. An apparatus according to claim 10, further including means for transferring the positive particle image from said blocking web to the sheet.

12. An apparatus according to claim 11, wherein said heated member is an arcuate member.

13. An apparatus according to claim 12, wherein said blocking web is entrained about said arcuate member.

14. An apparatus according to claim 13, wherein said projecting means includes a cathode ray tube.

15. An apparatus according to claim 14, wherein said cathode ray tube projects a negative image onto said imaging web.

16. An apparatus according to claim 12, further including:

means for storing unused portions of said imaging web;

means for receiving used portions of said imaging web; and means for advancing the used portion of said imaging web to said receiving means.

17. An apparatus according to claim 16, further including:

means for storing unused portions of said blocking web;

means for receiving used portions of said blocking web; and means for advancing the used portion of said blocking web to said receiving means.

* * * * *